US006192695B1

(12) United States Patent
Hirota

(10) Patent No.: US 6,192,695 B1
(45) Date of Patent: Feb. 27, 2001

(54) REFRIGERATING CYCLE

(75) Inventor: Hisatoshi Hirota, Tokyo (JP)

(73) Assignee: TGK Co., Ltd., Tokyo (JP)

( * ) Notice: Subject to any disclaimer, the term of this patent is extended or adjusted under 35 U.S.C. 154(b) by 0 days.

(21) Appl. No.: 09/179,775

(22) Filed: Oct. 27, 1998

(30) Foreign Application Priority Data

| | | |
|---|---|---|
| Nov. 14, 1997 | (JP) | 9-313261 |
| Apr. 1, 1998 | (JP) | 10-088637 |
| Jun. 18, 1998 | (JP) | 10-170423 |
| Oct. 7, 1998 | (EP) | 98118939 |

(51) Int. Cl.[7] ..... F25B 41/00; F25B 49/00
(52) U.S. Cl. ..... 62/196.4; 62/159; 62/503
(58) Field of Search ..... 62/503, 159, 196.4, 62/196.3, 278, 160, 324.1

(56) References Cited

U.S. PATENT DOCUMENTS

| | | | | |
|---|---|---|---|---|
| 2,701,455 | * | 2/1955 | Kleist | 62/126 |
| 2,953,906 | * | 9/1960 | Quick | 62/81 |
| 3,071,935 | * | 1/1963 | Kapeker | 62/155 |
| 3,167,930 | * | 2/1965 | Block et al. | 62/190 |
| 3,213,637 | * | 10/1965 | Halls | 62/278 |
| 3,636,723 | * | 1/1972 | Kramer | 62/197 |
| 3,792,594 | * | 2/1974 | Kramer | 62/503 |
| 4,720,980 | * | 1/1988 | Howland | 62/81 |
| 4,893,748 | | 1/1990 | Balducci | 237/2 A |
| 5,291,745 | * | 3/1994 | Hanson | 62/89 |
| 5,291,941 | | 3/1994 | Enomoto | 165/62 |

FOREIGN PATENT DOCUMENTS

| | | |
|---|---|---|
| 0 197 839 | 10/1986 | (EP) . |
| 36 35 353 | 10/1986 | (DE) . |
| 2 720 982 | 12/1995 | (FR) . |

* cited by examiner

*Primary Examiner*—Corrine McDermott
*Assistant Examiner*—Marc Norman
(74) *Attorney, Agent, or Firm*—Nilles & Nilles SC

(57) ABSTRACT

A refrigerating cycle with a by-pass duct 5 in which heat exchange for heating is arranged to be performed in an evaporator 4 without passing refrigerant through a condenser 2 is designed to perform an auxiliary heating mode suitable for the instantaneous conditions by controlling the amount of refrigerant circulating in response to the load and the like. A by-pass duct 5 for supplying the refrigerant from the compressor 1 to the evaporator 4 without passing it through the condenser 2 is placed in juxtaposition. Between the outlet of the evaporator 4 and the inlet of the compressor 1 an accumulator 6 for temporarily storing low-pressure refrigerant liquid is provided so that the amount of refrigerant circulating is controlled by accumulator 6 while the refrigerant circulates via by-pass duct 5 without passage through condenser 2.

68 Claims, 5 Drawing Sheets

REFRIGERATING CYCLE

BACKGROUND OF THE INVENTION

1. Field of the Invention

The present invention relates to a refrigerating cycle with a by-pass duct capable of using an evaporator, which usually is used for cooling purposes, for auxiliary heating as required. The refrigerating cycle preferably is intended for an automobile.

In an automotive air-conditioner a general refrigerating cycle is used for cooling purposes while an engine refrigerating cycle is used for cooling the engine and heating cooling water of the engine which cooling water when heated is used for heating e.g. the passenger compartment. However, recent engine developments resulted in engines with improved efficiency, for example gasoline injection type engines and direct injection diesel engines, in which the temperature of the cooling water does not rise as high as in the past. This leads to the inconvenience that particularly in winter time the heating temperature or heating capacity is no more sufficient for the passenger compartment.

2. Description of the Related Art

EP-A-0197839 corresponding to U.S. Pat. No. 4,893,748 relates to a heating method using an air-conditioner provided on board of a vehicle and comprising at least a compressor and an evaporator wherein the total or a part of the fluid is derived from the air-conditioning circuit after compression and then re-injected after pressure relief at the inlet of the evaporator in order to gain in a heating operational mode of said air-conditioner additional heating capacity for the passenger compartment. The structure of said heating device actually constituted by the slightly modified air-conditioner of conventional design includes an element for deriving a discharge fluid of the compressor towards a depression element for re-heating the atmospheric airflow across the evaporator prior to the entry of the atmospheric airflow into the cabin. Said depression element is able to deviate the condenser, the fluid receiver and the expansion valve of the air-conditioner by means of a by-pass duct connecting the exit of the compressor and the inlet of the evaporator. Said by-pass duct contains a depression element insuring an isoenthalpic pressure relief e.g. in the form of a flow rate regulator alone or in association with at least one additional parallel jet nozzle or including a jet nozzle having an adjustable flow section. In order to raise the heating efficiency a preheating device can be provided either in the airflow entering the evaporator or for preheating a buffer tank located downstream the condenser and/or the evaporator itself.

A climatization system of an automobile as known from DE A 3635353 is equipped with an additional heat exchanger located downstream of the main evaporator and upstream of an accumulator in front of the suction side of the compressor. Within the main circuit passing the condenser a by-pass duct is branching off to a junction in the main circuit located downstream the expansion valve situated downstream of the condenser. A further by-pass duct is connecting the exit of the evaporator and said accumulator and contains a motor-driven on/off-valve. The additional heat exchanger is also passed by the cooling medium of the engine. Upstream of said additional heat exchanger an additional expansion valve is provided. In the cooling mode said first by-pass duct and said second expansion valve and the heat exchanger are isolated. In the heating mode said second by-pass duct and the condenser with its downstream expansion valve are isolated. The airflow entering the passenger compartment is passing the evaporator. Said second heat exchanger is functioning as an additional evaporator for the refrigerant in the heating mode.

An air-conditioner as know from U.S. Pat. No. 5,291,941 is structurally modified for a heating mode by a by-pass duct deviating the condenser, a receiver, a check valve and an expansion valve all located downstream of said condenser, and is connecting the exit of the compressor with the inlet of the evaporator. Said by-pass duct is containing an on/off valve and a heating expansion valve. Between the evaporator and the inlet of the compressor an accumulator is provided. The evaporator is situated within an air duct to the passenger compartment upstream of a heater core connected to the engine and passed by the cooling water.

A further automotive air-conditioner known from FR A 2720982, FIG. 2, is functionally similar represented as a schematic block diagram in FIG. 9 of this application. A by-pass duct 5 is placed in juxtaposition to supply high-pressure refrigerant gas supplied from compressor 1 of the refrigerating cycle to an evaporator 4 within a car room with-out passing the refrigerant in the heating mode through condenser 2 provided outside the car room, for performing heat exchange by taking sensibly heat from the evaporator or, as an auxiliary heating. The refrigerating cycle of this conventional design contains an expansion valve 3, a liquid tank 10 for temporarily storing high-pressure refrigerant liquid, a check valve 7 between liquid tank 10 and expansion valve 3, a duct selector valve 8 for guiding high-pressure refrigerant delivered by the compressor 1 either to condenser 2 or to deviate it (heating mode) via by-pass duct 5. A constant differential pressure regulating valve 9 is situated in by-pass duct 5 which operates as expansion valve when the refrigerant flows through the by-pass duct 5. In the above described, conventional refrigerating cycle the amount of the refrigerant to be circulated becomes constant, since the refrigerant does not pass through the liquid tank 10 during the auxiliary heating mode. As a consequence, the amount of the refrigerant cannot be controlled in response to the load and the like. Therefore, heating cannot be performed in accordance with the conditions.

OBJECTS AND SUMMARY OF THE INVENTION

It is an object of the present invention to provide a refrigerating cycle having a by-pass duct in order to perform heat exchange for heating by the evaporator without causing refrigerant to pass through the condenser, which is capable to perform heating suitable for the conditions by controlling the amount of refrigerant circulated in response to the load and the like.

In order to achieve the above described object the refrigerating cycle according to the inventions designed in accordance with the features in claim 1. Within the refrigerating cycle having the by-pass duct in juxtaposition with a refrigerating cycle in which the refrigerant after it is compressed by the compressor and is condensed by the condenser is supplied to the evaporator while being adiabatically expanded by the expansion valve and is evaporated to be returned to the compressor, said by-pass duct serves to supply the refrigerant from the compressor to the evaporator without passing through the condenser. An accumulator for temporarily storing low-pressure refrigerant liquid and gas is connected between the outlet of the evaporator and the inlet of the compressor so that the amount of the refrigerant circulated in the heating mode is controlled by the accumulator while the refrigerant circulates through the by-pass duct without passing through the condenser.

The provision of the accumulator in the low-pressure line of the refrigeration cycle ensures easier control of the refrigerant flow during the heating mode. The accumulator at the inlet side of the compressor eliminates the necessity of a charge mode being indispensable in known refrigeration systems. Furthermore, the refrigerant flow that needs to be controlled in discharge mode in known systems is very weak, e.g. 0.5 g, but simply can be enlarged by a e.g. factor 100 by the provision of the accumulator at the inlet side of the compressor. By the accumulator located there the refrigerant flow that needs to be controlled in the discharge mode easily can be as much as 25 g. Said strong refrigerant flow automatically offers a means to control the refrigerant flow in a much easier way. It is possible to use a simpler switching valve and secure a longer duration of time to open and close the valve, e.g. as much as one second. No super-heating control is required at the compressor outlet. As a consequence, for the control of the refrigerating cycle, particularly in the heating mode, no microprocessor is required. However, the accumulator located close to the inlet of the compressor has to be designed with sufficient storing capacity for the gaseous and liquid phases of the refrigerant in order to be able to cope with varying load conditions, must have a predetermined and preferably low through-flow resistance and must be able to not only fulfil an oil separating function but also a predetermined oil re-delivery function in order to supply sufficient oil to the compressor together with the gaseous refrigerant sucked in by the compressor.

In a preferred embodiment there may be provided a heating expansion valve along the by-pass flow path from the exit of the compressor into the evaporator for adiabatically expanding the refrigerant before it enters the evaporator when being supplied to the evaporator through the by-pass duct without passing through the condenser after being compressed by the compressor.

In another preferred embodiment there may be provided a further expansion valve between the evaporator and its associated accumulator for adiabatically expanding the refrigerant before entering the accumulator and after it has passed the evaporator without previously passing through the condenser.

In a further embodiment a heating expansion valve is provided in the by-pass duct and the further expansion valve is provided between the evaporator and its associated accumulator.

In a further preferred embodiment a heat exchanger may be incorporated into the accumulator for performing heat exchange between heat from an energy source for the automobile on which the refrigerating cycle is mounted and the refrigerant in the refrigeration cycle.

In a further preferred embodiment, additionally or alternatively to the heat exchanger in the accumulator, a heat exchanger may be interposed in the refrigerant duct on the upstream side of the accumulator and connected adjacent thereto for performing heat exchange between heat from an energy source of the automobile on which the refrigerating cycle is mounted and the refrigerant circulating in the refrigeration cycle.

In a further preferred embodiment the main expansion valve provided for the cooling mode may include a mechanical expansion valve or an orifice tube with fixed orifice cross-section or an adjustable control valve maintaining constant supercooling by varying the valve opening, or a motor-driven controlled expansion valve.

In further preferred embodiment as the main expansion valve a specific supercooling expansion valve is used, e.g. instead of a conventionally provided orifice tube. By said supercooling expansion valve the refrigerating capacity can be significantly improved.

In another preferred embodiment said heating expansion valve may be designed as a pressure regulating valve apt to regulate its delivery pressure below a specified value by throttling its valve opening small when its delivery side pressure exceeds a specified value (e.g. 10×the atmospheric pressure) and/or a variable pressure regulating valve capable of varying its setting pressure by electromagnetic force.

In another preferred embodiment said heating expansion valve in said by-pass duct may be designed as a fixed or constant differential pressure regulating valve like a pressure reducing valve or a motor- or solenoid-driven multi-stage-pressure differential switching valve or a motor- or solenoid-driven control valve apt to be adjusted stepwise or steplessly.

In a further preferred embodiment said further expansion valve provided downstream of the evaporator may be designed as a finite differential pressure valve for reducing pressure between the evaporator and the accumulator, or as an intake pressure regulating valve for maintaining the pressure on the outlet side at a certain level or less by reducing the valve opening when the outlet side pressure exceeds a predetermined pressure value(e.g. 4×atmospheric pressure) or as a variable intake pressure regulating valve capable of varying the pre-set pressure by an electromagnetic force, or as a motor-driven control valve.

In a further preferred embodiment, in which the heating expansion valve is provided in the by-pass duct already, a further expansion valve downstream the evaporator may be designed with a fixed orifice only throttling the channel sectional area.

In a further preferred embodiment a further by-pass duct is deviating said further expansion valve located between the evaporator and the accumulator, said further by-pass duct containing a switchable on/off valve.

In a further preferred embodiment equipped with a heat exchanger between the evaporator and the accumulator a further by-pass duct may deviate both said further expansion valve and said heat exchanger, said further by-pass duct containing a switchable on/off valve.

In a further preferred embodiment said heat exchanger is passed by a heat transferring medium such as water. The flow rate of the heat transferring medium in said heat exchanger can be controlled by an associated flow control valve.

In a further preferred embodiment several controlled shut-off valves for directing the refrigerant flow are provided in the main duct between the compressor and the condenser, in the by-pass duct upstream the heating expansion valve, and in said by-pass duct deviating either the further expansion valve or the further expansion valve and the heat exchanger, wherein said shut-off valves are integrated into one structural valve block or block body. This facilitates installation of the cycle and allows to properly control both modes of operation.

In a further embodiment the accumulator is provided with a thermal insulation in order to avoid heat losses as far as possible. Said thermal insulation can be constituted by producing the body of the accumulator from heat insulating resin or similar plastic material and e.g. by applying an insulating cover on the body of said accumulator. Said cover is of particular advantage in case of a body of the accumulator made of aluminium alloy or a similar light metal alloy. Said cover can be made of a resin or similar plastic material or of rubber. By said thermal insulation heat dissipation from the refrigerant to the ambient atmosphere is forcibly prevented.

In a further preferred embodiment the high pressure duct section of the cycle connecting said switching valve and said check valve is structured as an intermediate storing section for excessive refrigerant during the oscillatory heating mode and in functional co-operation with said accumulator having a predetermined storing capacity only. The amount of refrigerant contained in the evaporator is different between the cooling mode and the auxiliary heating modes. In the auxiliary heating mode the amount of refrigerant contained in the evaporator will be less. The difference of the amounts between both operating modes could be stored in the accumulator. However, it would neither be economical or practical to increase the accumulator size and capacity accordingly. Instead, the cycle is structured such that by functional co-operation between the accumulator and the high pressure duct section of the cycle during auxiliary heating mode excessive refrigerant is stored in the high pressure duct section connecting said selector valve and said check valve, including said condenser. This means that the size and storing capacity of the accumulator can be the same as in conventional refrigerating cycles using an orifice tube system.

In a further preferred embodiment the accumulator is equipped with a signal generating liquid level gauge, e.g. connected with the control system of the cycle or directly with the actuation of selector valves. During the auxiliary heating mode signals originating from said level gauge can be used to reduce the refrigerant flow to be circulated in the auxiliary heating circuit by opening the selector valve for a short period of time (in the range of one to five seconds) and thus diverting the refrigerant flow towards the condenser if the refrigerant needs to be stored exceeding the refrigerant storing capacity of the accumulator.

In a further preferred embodiment said liquid level gauge is constituted by a selfheating thermistor or an equivalent electronic component integrated into said accumulator. A self-heating thermistor is able to dissipate a certain heat amount when drawing a certain current. Its characteristic is to significantly change its heat dissipation factor when it is immersed in the liquid refrigerant or left in the gaseous refrigerant. Said change easily can be detected by the current supplied to the thermistor gaining an output signal useful to control e.g. the selector valve accordingly and temporarily.

BRIEF DESCRIPTION OF THE DRAWINGS

Embodiments of the refrigerating cycle according to the invention as well as an embodiment of a known refrigerating cycle will be described with the help of the drawings. In the drawings is.

DESCRIPTION OF THE PREFERRED EMBODIMENTS

Figure 1:
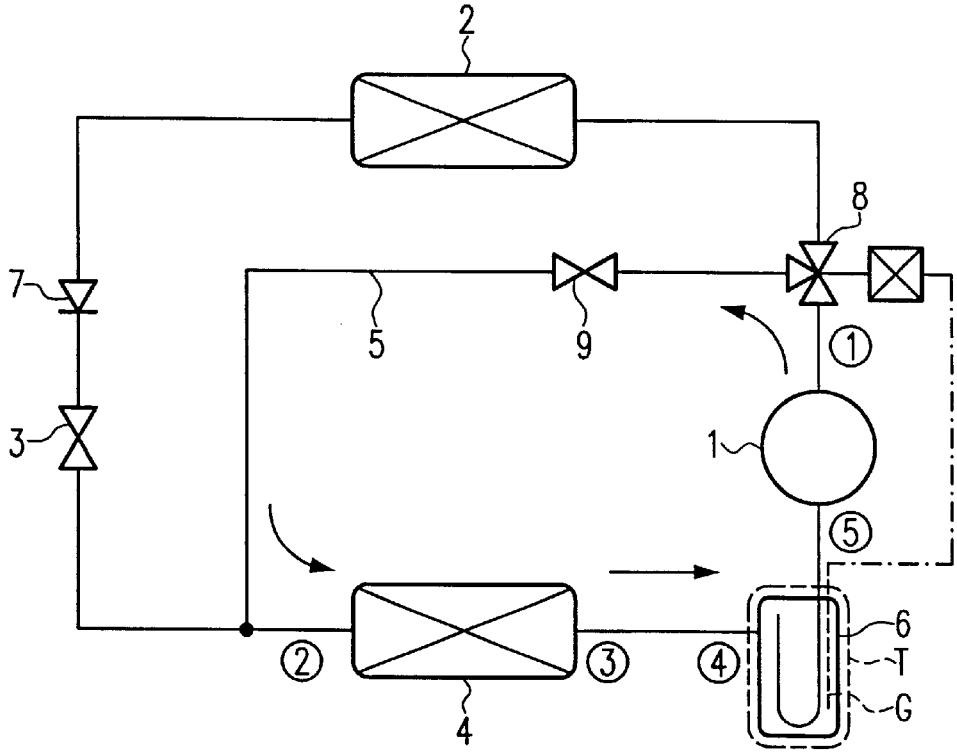
FIG. 1—a schematic view of the general structure of a refrigerating cycle as a first embodiment of the invention, FIG. 2—a characteristic chart representing the operation of the first embodiment, FIG. 3—a schematic view of a second embodiment of the invention, FIG. 4—a characteristic chart representing the operation of the second embodiment, FIG. 5—a schematic view of a third embodiment of the invention, FIG. 6—a schematic view of a fourth embodiment of the invention, FIG. 7—a characteristic chart representing the operation of the fourth embodiment, FIG. 8—a schematic view of a fifth embodiment of the invention, and FIG. 9—a schematic view showing a conventional refrigerating cycle with a by-pass duct for heating purposes.

In FIG. 1 the general structure of a refrigerating cycle used in an automotive air-conditioner contains (first embodiment of the invention) a compressor 1, a condenser 2 arranged outside a car room, an expansion valve 3 downstream of said condenser 2 in the main circuit, an evaporator 4 arranged in an air duct leading to the car room and an accumulator 6 for temporarily storing low-pressure refrigerant, all of which constitute an ordinary refrigerating cycle. Expansion valve 3 can be a general mechanical expansion valve. Alternatively or in addition to said general mechanical expansion valve, an orifice tube (e.g. with a diameter of 1.6 mm and a length of 33 mm) can be used, or a supercooling control valve, or even a motor-driven control expansion valve or the like. Said supercooling control valve or supercooling expansion valve, respectively, is designed to maintain the degree of supercooling constant by enlarging the valve opening when the degree of supercooling at the valve's inlet side tends to become high.

In addition to the ordinary refrigerating cycle described above a by-pass duct 5 is placed in juxtaposition for supplying high-pressure refrigerant gas delivered by the compressor 1 into the evaporator 4 without passing it through the condenser 2 in order to perform auxiliary heating by using the evaporator. Also in addition check valve 7 is provided in the main duct downstream of condenser 2 and upstream of main expansion valve 3. Furthermore, a duct selector valve 8 (a three- way valve e.g.) is provided at the junction between the main circuit and the branching off by-pass duct 5 for guiding high-pressure refrigerant supplied from the compressor 1 either to the condenser 2 or (heating mode) via by-pass duct 5 directly to the evaporator 4. By-pass duct 5 contains e.g. a constant differential pressure regulating valve 9 for-reducing the pressure. Said valve 9 operates as an expansion valve in said by-pass duct 5.

As said finite differential pressure valve 9 special types of valves may be used. Said valve 9 may be a valve capable of switching the controlled differential pressure to two stages (e.g. 13 and 7 atmospheres) or three or more stages by means of a solenoid or the like. Even a motor-driven control valve may be used, which can be adjustable in steps or steplessly.

In said refrigerating cycle as described above in the cooling mode the duct selector valve 8 is set so that all the high-pressure refrigerant supplied from the compressor does not flow into by-pass duct 5 but is supplied to condenser 2. Then the evaporator 4 (either arranged in the car room or in the air path into the car room) operates as a conventional evaporator performing cooling by means of heat exchange between the surrounding air and the refrigerant.

During auxiliary heating duct selector valve 8 is set so that all high-pressure refrigerant supplied from the compressor 1 does not flow to the condenser 2 but flows through by-pass duct 5 and returns to the compressor 1 via evaporator 4 and the accumulator 6.

Then the refrigerant is passing through the evaporator 4 after being reduced in its pressure by means of expansion when passing the finite differential pressure valve 9. A considerable heat exchange is performed during which sensible heat brought into the refrigerant in the compressor 1 is taken from the refrigerant, and evaporator 4 is operating as a radiator for auxiliary heating. During auxiliary heating excessive liquid refrigerating is stored in the high pressure duct section of the refrigerating cycle between selector valve 8 and check valve 7, which high pressure duct section is structured as a temporary storing portion of the cycle. Furthermore, in each embodiment accumulator 6 can be thermally insulated, e.g. by manufacturing its body from insulating plastic material and/or by applying an insulating cover T (preferably on a body made from light metal alloy) as indicated, e.g. in FIG. 1. Additionally, a liquid level gauge G ought to be provided in accumulator 6. This can be current supplied and thus self-heating thermistor which significantly changes its heat dissipation factor when immersed in the liquid refrigerant or left in the gaseous refrigerant. The current consumed by the thermistor then will vary. This variation can be taken as a signal for e.g. controlling selector valve 8 during the oscillatory heating mode to temporarily open the flow connection into the condenser 2 (during a time range one to five seconds) thus diverting the refrigerant flow toward the condenser 2 if excessive liquid refrigerant needs to be stored exceeding the storing capacity of accumulator 6. Then the already mentioned section of the cycle duct including condenser 2 is used as a temporary intermediate storing facility.

Figure 2:
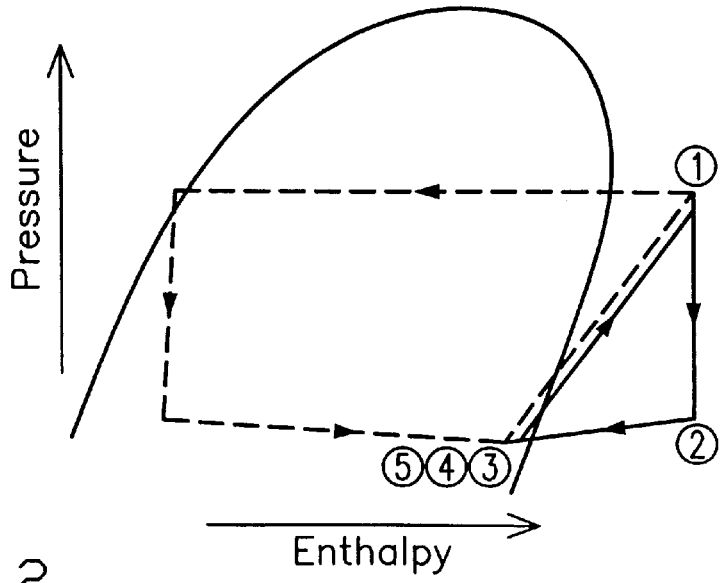

FIG. 2 shows the characteristics of the cycle in operation in solid line. Numeral ① denotes the outlet of the compressor 1, numeral ② denotes the inlet of the evaporator 4, numeral ③ denotes the outlet of the evaporator 4, numeral ④ denotes the inlet of the accumulator 6, and numeral ⑤ denotes the inlet of the compressor 1, and between ①–② shows expansion, between ②–③ shows radiation, and between ⑤–① shows compression.

When the refrigerant flows via by-pass duct 5 and through evaporator 4 in the auxiliary heating mode the accumulator 6 is apt to receive refrigerant in the circulation duct. Accordingly, when the load is small, a large amount of refrigerant is stored in accumulator 6. To the contrary, when the load is high the amount of refrigerant delivered by the accumulator 6 to compressor 1 is increased so that the amount of refrigerant circulating varies depending on the load. As a result, an auxiliary heating effect corresponding to the needs or demands can be obtained.

The location of accumulator 6 in the low-pressure section of the refrigerating cycle between the evaporator and the compressor 1 ensures easy control of the refrigerant flow in the heating mode. The accumulator with its storing capacity may eliminate the necessity for a so-called charge mode. Furthermore, the refrigerant flow that needs to be controlled in the discharge mode is extremely high, compared to conventional systems. In conventional systems the refrigerant flow in the discharge mode may be as low as 0.25 g only. With the help of accumulator 6 according to the invention the refrigerant flow in the discharge mode can be e.g. 100 times greater and can be as much as 25 g. Such high flow is offering a means for controlling the refrigerant flow in a much easier way. It is thus possible to use a simpler switching valve and to secure a longer duration of time to open and close the valve. e.g. as much as one second or more. Due the positive influence of accumulator 4 no superheat control is required at the compressor outlet side and, consequently, no microprocessor is required for the control of at least the heating mode.

Figure 3:
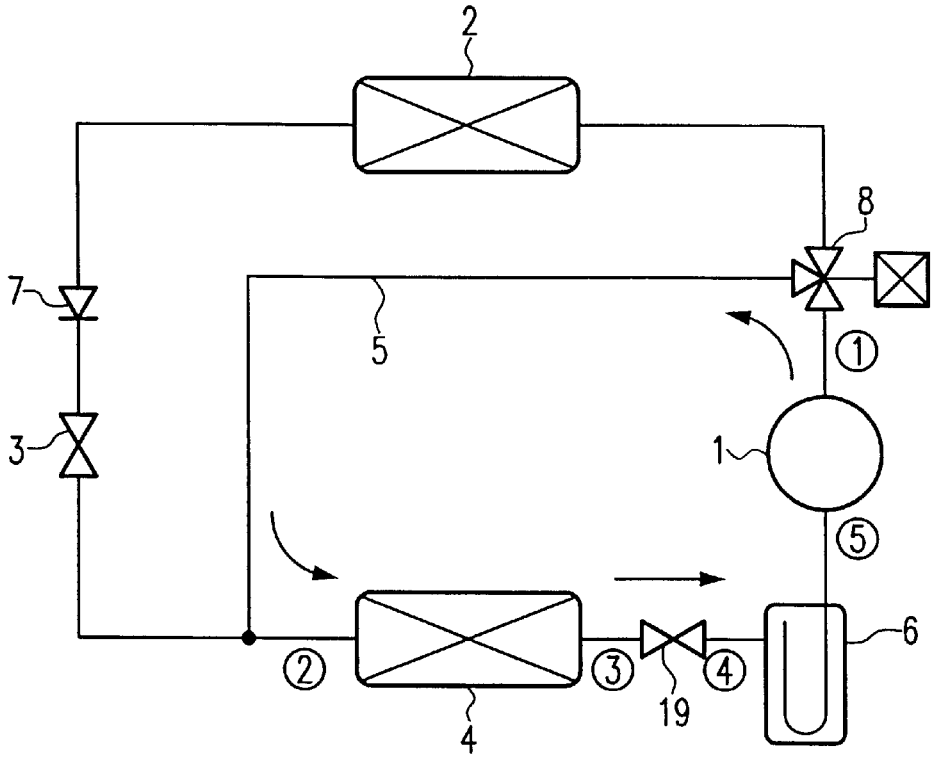

In the second embodiment in FIG. 3 the refrigerating cycle is equipped with a further or second expansion valve 19 between the evaporator 4 and the accumulator 6. Said expansion valve 19 can consist, e.g., of a finite differential pressure valve for reducing the pressure. In FIG. 3 no finite differential pressure valve (expansion valve) is provided between compressor 1 and evaporator 4, i.e. in by-pass duct 5. The further structural design of this embodiment is the same as in the first embodiment.

Figure 4:
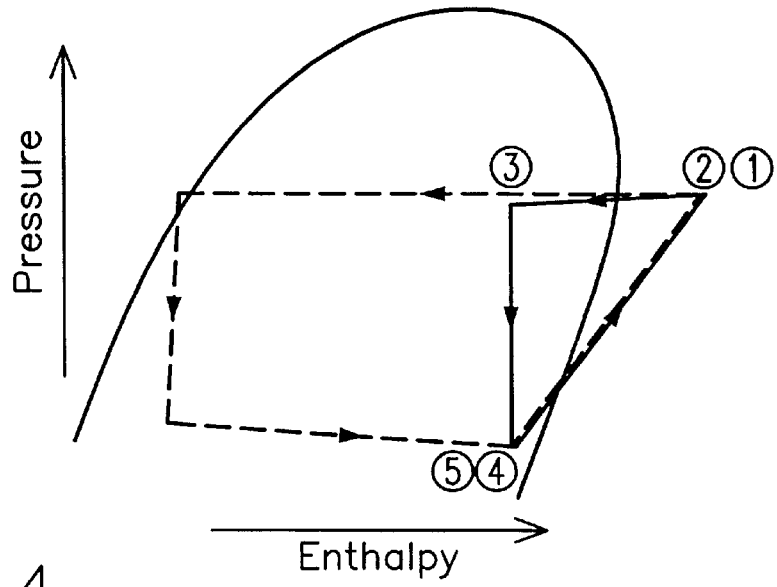

FIG. 4 represents the operation of the second embodiment in the heating mode, i.e. when the refrigerant flows through by-pass duct 5. Evaporator 4 functions as a condenser in the case of a general refrigerating cycle as shown in FIG. 4. Radiation is performed between ②–③ to obtain said auxiliary heating effect.

Also in the second embodiment the amount of refrigerant circulating is controlled in response to the load by accumulator 6 located in the refrigerant circulating duct. As a consequence, the required auxiliary heating effect corresponding to the needs can be obtained.

Figure 5:
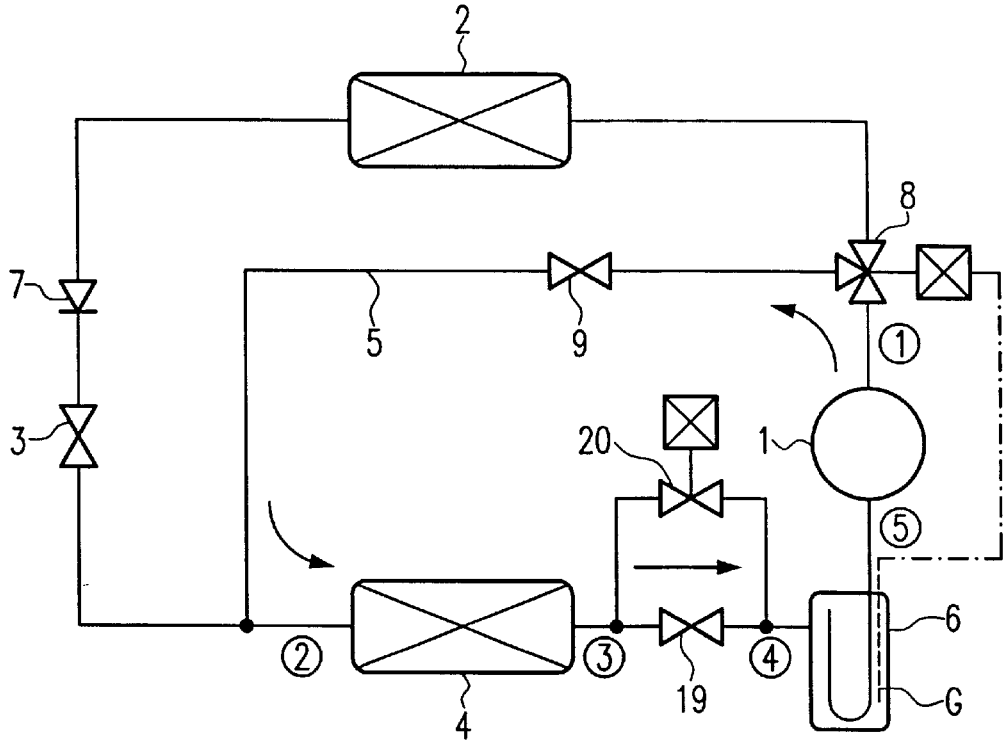

In the third embodiment in FIG. 5 a finite differential pressure valve 9 (expansion valve) is interposed in by-pass duct 5 between duct selector valve 8 and evaporator 4. Between evaporator 4 and accumulator 6 a further second expansion valve 19 (for the heating mode) is provided.

As a result the expansion of the refrigerant during auxiliary heating mode is carried our at two places, namely in the finite differential pressure valve 9 and in the second expansion valve 19, so that both valves function as expansion valves. Consequently, the pressure of refrigerant passing the evaporator is lower than in the second embodiment so that the pressure resistance of evaporator 4 can be set to be low.

In addition to the structure of the other embodiments the third embodiment contains an on/off control valve 20 in a by-pass duct deviating the further expansion valve 19. During an ordinary cooling mode of the refrigerating cycle valve 20 is opened in order to allow the refrigerant to deviate expansion valve 19. Of course, then refrigerant also is not passing through by-pass duct 5. The further components of the refrigeration cycle in FIG. 5 are the same as in the first embodiment.

In the third embodiment, e.g., the further expansion valve 19 a valve may be used which functions as a finite differential pressure valve. It even is possible to use intake pressure regulating valve for maintaining the pressure at the outlet side of said valve at a certain level or lower by reducing the valve opening as soon as the outlet side pressure exceeds a predetermined pressure value (e.g. 4×atmospheric pressure). Alternatively a variable intake pressure regulating valve could be used apt to vary the pre-set pressure by electromagnetic force or the like. Even a motor-driven control valve or the like may be used instead or in addition.

Generally said expansion valve may be used as the pressure regulating valve 9. This valve is capable of maintaining its outlet pressure at a specified pressure value or lower by reducing the degree of its opening if its outlet pressure has exceeded a specified level (e.g. 10 times that of the atmospheric pressure). The evaporator 4 will be immune to potential damage if said pressure regulating value 9 is provided, since this is capable of maintaining the evaporating pressure in the evaporator 4 at a specified pressure or lower. Further, a simple orifice can be used as the expansion valve 19 if said pressure regulating valve is provided in addition to said expansion valve 9. Moreover, a variable pressure regulating valve could be used as said pressure regulating valve being capable of being adjusted in its setting by electromagnetic force.

Figure 6:
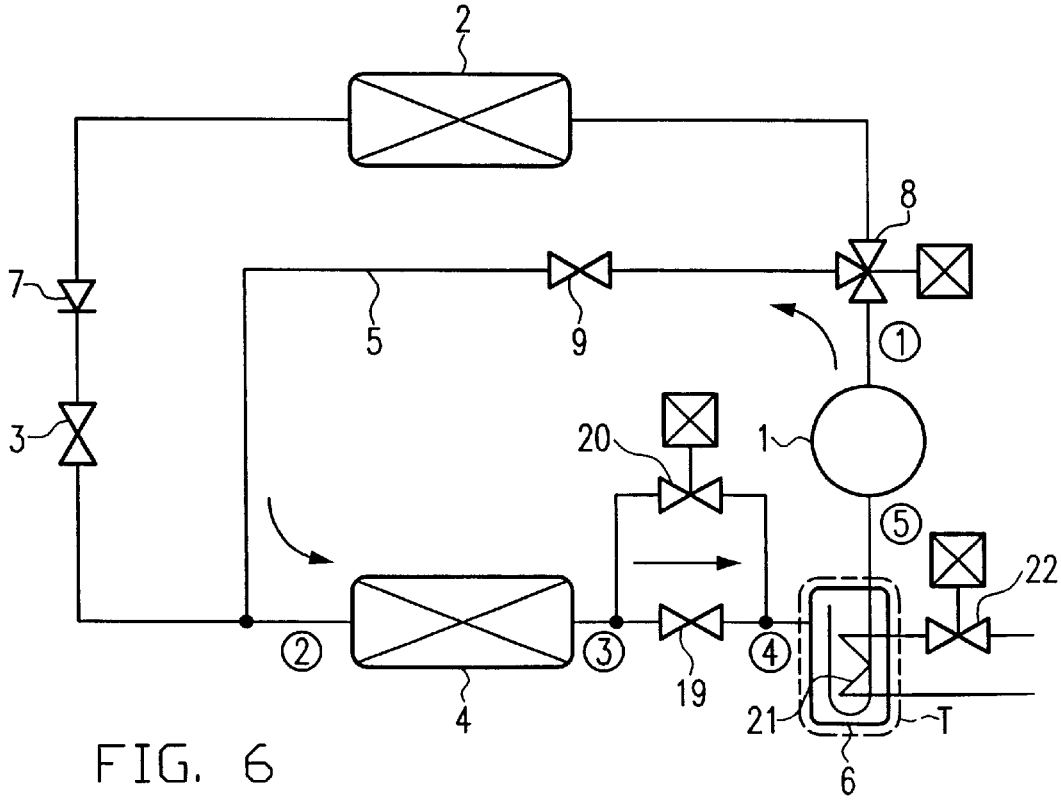

In the fourth embodiment of FIG. 6 additionally a heat exchanger 21 is provided at or within accumulator 6. Heat exchanger 21 exchanges heat discharged from an automobile engine, from any type of motor or from batteries with the refrigerant received in the accumulator 6. A flow control valve 22 can be provided to control the flow rate of a waste heat transferring medium, such as water, etc. in heat exchanger 21. Further components of the refrigerating cycle correspond to the other embodiments.

Figure 7:
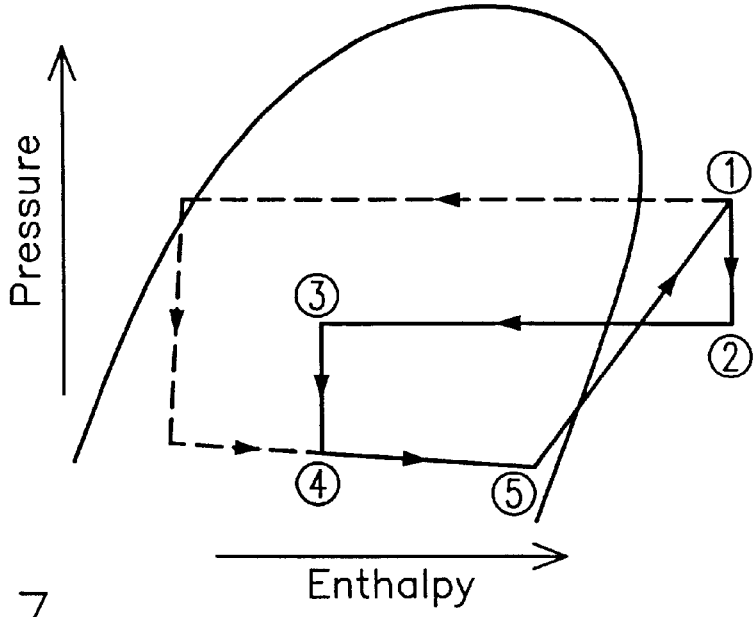

By means of heat exchanger 21 at or in accumulator 6 heat is transferred to a refrigerant and as such also can be used for auxiliary heating. When in this auxiliary heating mode the refrigerant flows through by-pass duct 5 a large quantity of radiation is carried out in evaporator 4 between ② and ③ as shown in FIG. 7, i.e. the characteristic diagram of the operation of this embodiment. The auxiliary heating affect can be improved therewith.

Also in this embodiment the circulation rate of the refrigerant is easily controlled by accumulator 6 in the refrigerant circulating line and in view to an adaptation of the auxiliary heating affect to the necessity or need in the car room.

Figure 8:
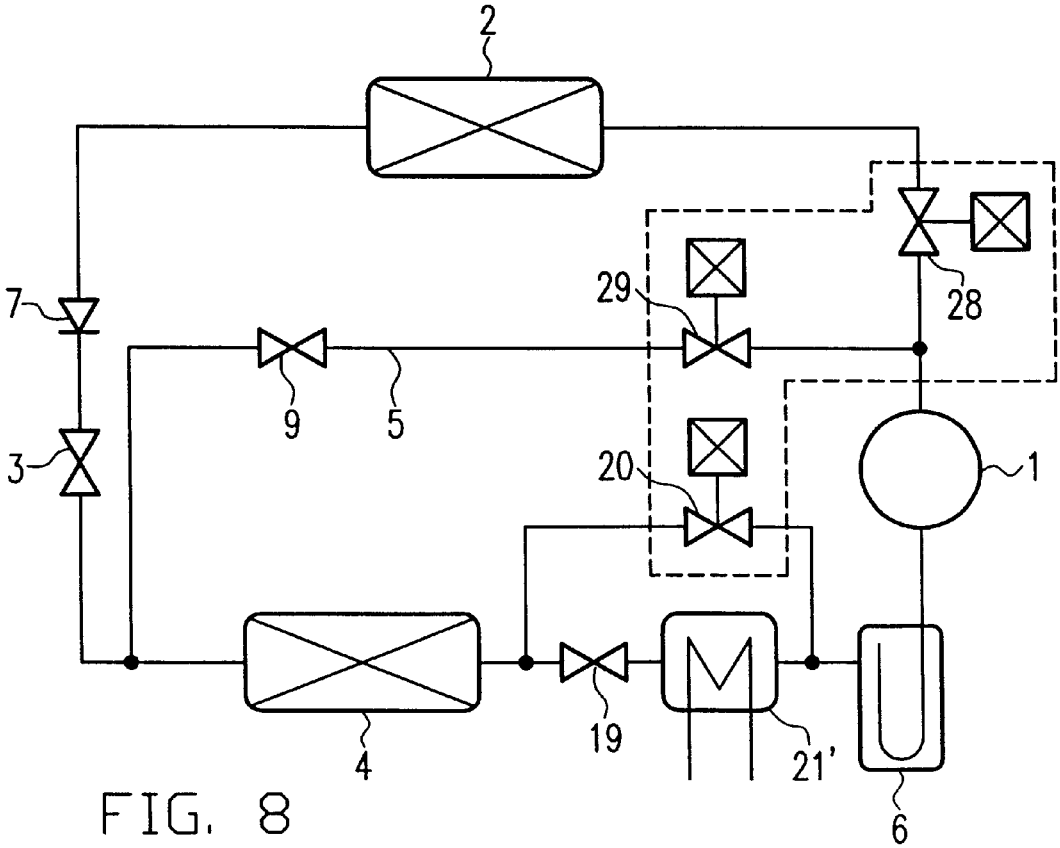
Figure 9:
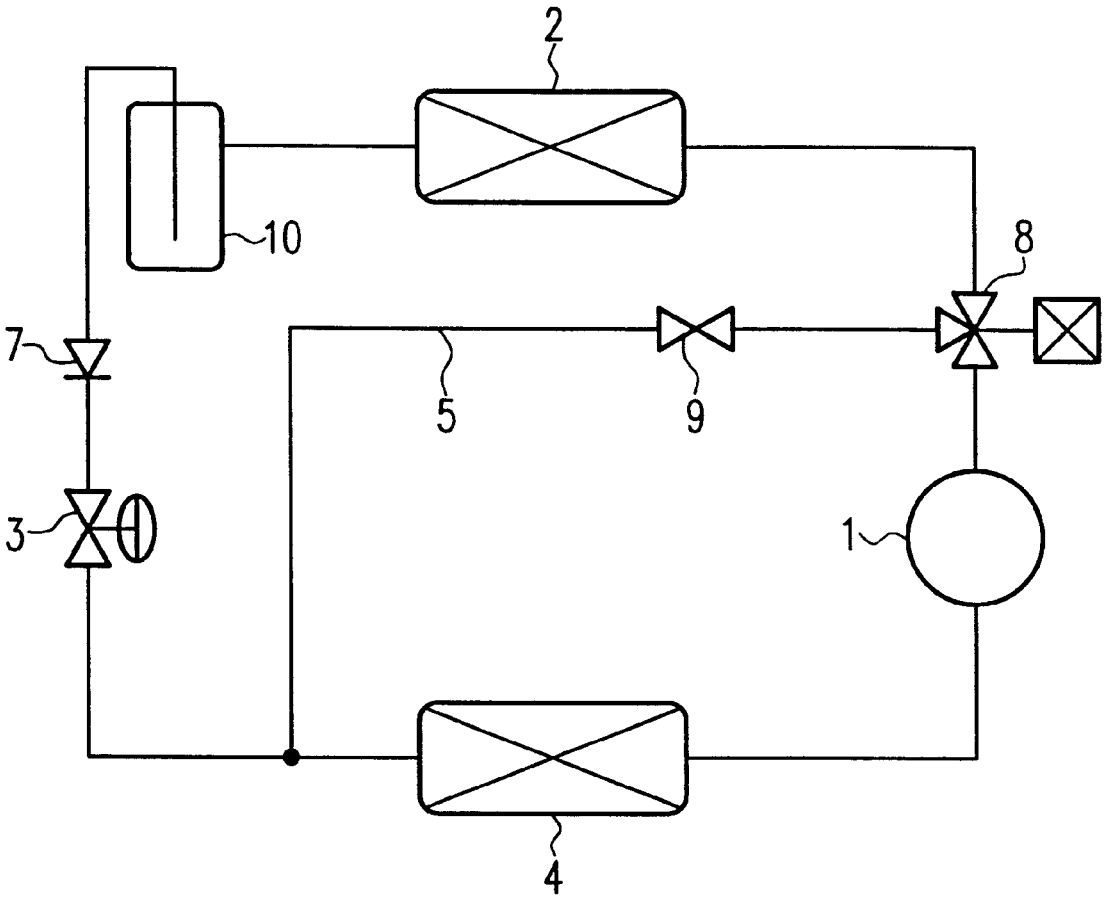
FIG. 9 (PRIOR ART)

In the fifth embodiment of FIG. 8 additionally heat exchanger 21' is provided between further expansion valve 19 and accumulator 6. Heat exchanger 21' serves to exchange heat discharged from the automobile engine, from another type of motor or via batteries with the refrigerant between the further expansion valve 19 and the accumulator 6. This embodiment is capable of performing the same heating affect as the fourth embodiment. Both the further expansion valve 19 and heat exchanger 21' are deviated in their refrigerant duct by a parallel by-pass duct containing a controlled on/off valve 20. Said on/off valve 20 is closed in the auxiliary heating mode, but is open during the normal cooling mode.

Furthermore, in the fifth embodiment, instead of duct selector valve 8 as shown with the other embodiments, said duct selector valve 8 is replaced by functionally similar shut-off valves 28, 29 and 20 for respectively directing the refrigerant flow in the cooling mode and in the auxiliary heating mode. Those three valves 28, 29 and 20 preferably are incorporated into one block or valve block or structural unit.

According to the invention the refrigerant delivered from the compressor directly can be supplied to the evaporator without passing the condenser. The accumulator is provided between the outlet of the evaporator and the inlet of the compressor in order to temporarily store low-pressure refrigerant liquid and also refrigerant in its gaseous phase. By means of said accumulator the amount of refrigerant circulating is controlled when the refrigerant circulates through the by-pass duct without passing the condenser. Therefore, even in the case of heat exchange for heating in the evaporator without passing the refrigerant through the condenser, the amount of refrigerant circulating is properly controlled in response to the load and the like so that a heating effect corresponding to the conditions can be obtained.

What is claimed is:

1. A refrigerating cycle having a by-pass duct in juxtaposition therewith for supplying a refrigerant delivered by a compressor into an evaporator, wherein the refrigerant by passes a condenser, is adiabatically expanded by an expansion valve, and is evaporated and returned to the compressor, the refrigerating cycle comprising:

an accumulator for temporarily storing the low-pressure refrigerant connected between an outlet of the evaporator and an inlet of the compressor, wherein the accumulator controls an amount of the refrigerant circulating in a heating mode of the refrigerating cycle that circulates through the by-pass duct without passing through the condenser; and a heat exchanger coupled to the accumulator, wherein the heat exchanger exchanges heat discharged from an energy source with the refrigerant received in the accumulator and includes a heat transferring medium controlled by a control valve.

2. The refrigerating cycle according to claim 1, wherein the refrigerating cycle is mounted on an automobile.

3. The refrigerating cycle according to claim 2, wherein the energy source is an engine.

4. The refrigerating cycle according to claim 2, wherein the energy source is a motor.

5. The refrigerating cycle according to claim 2, wherein the energy source is a battery.

6. The refrigerating cycle according to claim 1, wherein a check valve is on a downstream side of the condenser and an upstream side of the expansion valve.

7. The refrigerating cycle according to claim 1, wherein the heat exchanger is housed within the accumulator.

8. The refrigerating cycle according to claim 1, wherein the heat exchanger is adjacent to the accumulator.

9. The refrigerating cycle according to claim 1, wherein the heat transferring medium is water.

10. The refrigerating cycle according to claim 1, wherein the expansion valve is a mechanical valve that maintains a cooling constant by increasing or decreasing an opening of the valve when a measured cooling parameter at an inlet side of the valve is higher or lower than the cooling constant.

11. The refrigerating cycle according to claim 1, wherein the expansion valve is an orifice tube having a fixed orifice cross-section at an opening of the tube.

12. The refrigerating cycle according to claim 1, wherein the expansion valve is a motor-driven proportional control valve that maintains a cooling constant by adjusting an opening of the valve based on whether a measured cooling parameter at an inlet side of the valve is higher or lower than the cooling constant.

13. The refrigerating cycle according to claim 1, wherein the accumulator is thermally insulated.

14. The refrigerating cycle according to claim 13, wherein the accumulator is formed from a heat insulating resin.

15. The refrigerating cycle according to claim 13, wherein an outside surface of the accumulator is covered with an insulating cover.

16. The refrigerating cycle according to claim 15, wherein the insulating cover is a resin material.

17. The refrigerating cycle according to claim 15, wherein the insulating cover is a plastic material.

18. The refrigerating cycle according to claim 15, wherein the insulating cover is a rubber material.

19. The refrigerating cycle according to claim 1, wherein the accumulator includes a signal generating liquid level gauge connected to a duct selector valve.

20. The refrigerating cycle according to claim 1, wherein the accumulator includes a signal generating liquid level gauge connected to a plurality of shut-off valves.

21. The refrigerating cycle according to claim 1, wherein the accumulator includes a signal generating liquid level gauge connected to a control unit of the cycle.

22. The refrigerating cycle according to claim 21, wherein the gauge includes a current-supplied, self-heating thermistor integrated into the accumulator for detecting the liquid level by a change of a heat dissipating factor upon contact with the refrigerant in either a liquid or a gaseous state.

23. The refrigerating cycle according to claim 21, wherein the gauge includes an electronic component integrated into the accumulator for detecting the liquid level by a change of a heat dissipating factor upon contact with the refrigerant in either a liquid or a gaseous state.

24. The refrigerating cycle according to claim 1, wherein the heat exchanger is connected to a refrigerant duct on an upstream side of the accumulator and on a downstream side of the evaporator.

25. A refrigerating cycle having a by-pass duct in juxtaposition therewith for supplying a refrigerant delivered by a compressor into an evaporator, wherein the refrigerant by passes a condenser, is adiabatically expanded by an expansion valve, and is evaporated and returned to the compressor, the refrigerating cycle comprising:

an accumulator for temporarily storing the low-pressure refrigerant connected between an outlet of the evaporator and an inlet of the compressor, wherein the accumulator controls an amount of the refrigerant circulating in a heating mode of the refrigerating cycle that circulates through the by-pass duct without passing through the condenser; and a heat exchanger connected to a refrigerant duct on an upstream side of the accumulator, wherein the heat exchanger exchanges heat discharged from an energy source with the refrigerant received in the accumulator and includes a heat transferring medium controlled by a control valve.

26. The refrigerating cycle according to claim 25, wherein the heat exchanger is connected to the refrigerant duct on a downstream side of the evaporator.

27. The refrigerating cycle according to claim 25, wherein the refrigerating cycle is mounted on an automobile.

28. The refrigerating cycle according to claim 27, wherein the energy source is an engine.

29. The refrigerating cycle according to claim 27, wherein the energy source is a motor.

30. The refrigerating cycle according to claim 27, wherein the energy source is a battery.

31. The refrigerating cycle according to claim 25, wherein the heat transferring medium is water.

32. The refrigerating cycle according to claim 25, wherein the expansion valve is a mechanical valve that maintains a cooling constant by increasing or decreasing an opening of the valve when a measured cooling parameter at an inlet side of the valve is higher or lower than the cooling constant.

33. The refrigerating cycle according to claim 25, wherein the expansion valve is an orifice tube having a fixed orifice cross-section at an opening of the tube.

34. The refrigerating cycle according to claim 25, wherein the expansion valve is a motor-driven proportional control valve that maintains a cooling constant by adjusting an opening of the valve based on whether a measured cooling parameter at an inlet side of the valve is higher or lower than the cooling constant.

35. The refrigerating cycle according to claim 25, wherein the accumulator is thermally insulated.

36. The refrigerating cycle according to claim 35, wherein the accumulator is formed from a heat insulating resin.

37. The refrigerating cycle according to claim 35, wherein an outside surface of the accumulator is covered with an insulating cover.

38. The refrigerating cycle according to claim 37, wherein the insulating cover is a resin material.

39. The refrigerating cycle according to claim 37, wherein the insulating cover is a plastic material.

40. The refrigerating cycle according to claim 37, wherein the insulating cover is a rubber material.

41. The refrigerating cycle according to claim 25, wherein the accumulator includes a signal generating liquid level gauge connected to a duct selector valve.

42. The refrigerating cycle according to claim 25, wherein the accumulator includes a signal generating liquid level gauge connected to a plurality of shut-off valves.

43. The refrigerating cycle according to claim 25, wherein the accumulator includes a signal generating liquid level gauge connected to a control unit of the cycle.

44. The refrigerating cycle according to claim 43, wherein the gauge includes a current-supplied, self-heating thermistor integrated into the accumulator for detecting the liquid level by a change of a heat dissipating factor upon contact with the refrigerant in either a liquid or a gaseous state.

45. The refrigerating cycle according to claim 43, wherein the gauge includes an electronic component integrated into the accumulator for detecting the liquid level by a change of a heat dissipating factor upon contact with the refrigerant in either a liquid or a gaseous state.

46. A refrigerating cycle having a by-pass duct in juxtaposition therewith for supplying a refrigerant delivered by a compressor into an evaporator, wherein the refrigerant by passes a condenser, is adiabatically expanded by an expansion valve, and is evaporated and returned to the compressor, the refrigerating cycle comprising:

a thermally-insulated accumulator for temporarily storing the low-pressure refrigerant connected between an outlet of the evaporator and an inlet of the compressor, wherein the accumulator controls an amount of the refrigerant circulating in a heating mode of the refrigerating cycle that circulates through the by-pass duct without passing through the condenser.

47. The refrigerating cycle according to claim 46, wherein the cycle further comprises a heat exchanger coupled to the accumulator, wherein the heat exchanger exchanges heat discharged from an energy source with the refrigerant received in the accumulator and the flow of a heat transferring medium in the heat exchanger is controlled by a control valve.

48. The refrigerating cycle according to claim 47, wherein the refrigerating cycle is mounted on an automobile.

49. The refrigerating cycle according to claim 48, wherein the energy source is an engine.

50. The refrigerating cycle according to claim 48, wherein the energy source is a motor.

51. The refrigerating cycle according to claim 48, wherein the energy source is a battery.

52. The refrigerating cycle according to claim 47, wherein the heat exchanger is housed within the accumulator.

53. The refrigerating cycle according to claim 47, wherein the heat exchanger is adjacent to the accumulator.

54. The refrigerating cycle according to claim 47, wherein the heat transferring medium is water.

55. The refrigerating cycle according to claim 47, wherein the expansion valve is a mechanical valve that maintains a cooling constant by increasing or decreasing an opening of the valve when a measured cooling parameter at an inlet side of the valve is higher or lower than the cooling constant.

56. The refrigerating cycle according to claim 47, wherein the expansion valve is an orifice tube having a fixed orifice cross-section at an opening of the tube.

57. The refrigerating cycle according to claim 47, wherein the expansion valve is a motor-driven proportional control valve that maintains a cooling constant by adjusting an opening of the valve based on whether a measured cooling parameter at an inlet side of the valve is higher or lower than the cooling constant.

58. The refrigerating cycle according to claim 47, wherein the heat exchanger is connected to a refrigerant duct on an upstream side of the accumulator and on a downstream side of the evaporator.

59. The refrigerating cycle according to claim 46, wherein the accumulator is formed from a heat insulating resin.

60. The refrigerating cycle according to claim 46, wherein an outside surface of the accumulator is covered with an insulating cover.

61. The refrigerating cycle according to claim 60, wherein the insulating cover is a resin material.

62. The refrigerating cycle according to claim 60, wherein the insulating cover is a plastic material.

63. The refrigerating cycle according to claim 60, wherein the insulating cover is a rubber material.

64. The refrigerating cycle according to claim 46, wherein the accumulator includes a signal generating liquid level gauge connected to a duct selector valve.

65. The refrigerating cycle according to claim 46, wherein the accumulator includes a signal generating liquid level gauge connected to a plurality of shut-off valves.

66. The refrigerating cycle according to claim 46, wherein the accumulator includes a signal generating liquid level gauge connected to a control unit of the cycle.

67. The refrigerating cycle according to claim 66, wherein the gauge includes a current-supplied, self-heating thermistor integrated into the accumulator for detecting the liquid level by a change of a heat dissipating factor upon contact with the refrigerant in either a liquid or a gaseous state.

68. The refrigerating cycle according to claim 66, wherein the gauge includes an electronic component integrated into the accumulator for detecting the liquid level by a change of a heat dissipating factor upon contact with the refrigerant in either a liquid or a gaseous state.

* * * * *